US008033783B2

(12) United States Patent
Ishikawa et al.

(10) Patent No.: US 8,033,783 B2
(45) Date of Patent: Oct. 11, 2011

(54) DIAGONAL FLOW FAN

(75) Inventors: Shizu Ishikawa, Chiba (JP); Fumiaki Ishida, Sakura (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 1007 days.

(21) Appl. No.: 11/834,821

(22) Filed: Aug. 7, 2007

(65) Prior Publication Data

US 2008/0152480 A1 Jun. 26, 2008

(30) Foreign Application Priority Data

Dec. 20, 2006 (JP) ..... 2006-342071

(51) Int. Cl.
*F04D 29/66* (2006.01)

(52) U.S. Cl. ..... 415/119; 415/220; 415/224

(58) Field of Classification Search ..... 415/119, 415/220, 224; 181/224, 225
See application file for complete search history.

(56) References Cited

U.S. PATENT DOCUMENTS

| | | | | |
|---|---|---|---|---|
| 2,869,670 | A * | 1/1959 | Hoffman | 181/229 |
| 3,540,547 | A * | 11/1970 | Waddell, Jr. | 181/225 |
| 3,727,593 | A * | 4/1973 | Enke | 123/41.12 |
| 4,421,202 | A * | 12/1983 | Hoy | 181/252 |
| 4,508,486 | A * | 4/1985 | Tinker | 415/119 |
| 6,575,695 | B1 * | 6/2003 | Miyamoto | 415/119 |
| 6,978,827 | B2 * | 12/2005 | Armstrong | 165/80.3 |

FOREIGN PATENT DOCUMENTS

| | | |
|---|---|---|
| CN | 2259516 | 8/1997 |
| JP | 8-189333 | 7/1996 |
| JP | 10-103728 | 4/1998 |
| JP | 11-141491 | 5/1999 |
| JP | 11-201099 | 7/1999 |
| JP | 2001-115821 | 4/2001 |
| JP | 2005-163598 | 6/2005 |
| JP | 2005-214049 | 8/2005 |

OTHER PUBLICATIONS

Kruger Technical Bulletin TBN008.0/1998, pp. 1-2, 1998.*
Patent Office of the People's Republic of China Office Action with translation of Application No. 200710146508.2.
Japanese Office Action of Japanese Application 2006-342071.

* cited by examiner

*Primary Examiner* — Ninh H Nguyen
(74) *Attorney, Agent, or Firm* — Antonelli, Terry, Stout & Kraus, LLP.

(57) ABSTRACT

The present invention aims at providing a diagonal flow fan or a silencer for the diagonal flow fan, which have the same outer shape as a suction port and are compact, and can also obtain an effective sound absorbing effect of a moderate frequency range. In the diagonal flow fan comprising a diagonal flow impeller 1 disposed with a blade 1*a* so as to obliquely send an air to an axis of rotation 21, a fan casing 2 for covering this diagonal flow impeller 1, and a suction port 3 for sucking the fluid in the direction to the axis of rotation of this fan casing 2, the open front side of the suction port 3 is provided with a silencing portion comprising a shield 4 and a punching metal 5, so that the noise of the moderate frequency range of 500 to 1000 Hz generated in the diagonal flow fan was suppressed.

13 Claims, 4 Drawing Sheets

DIAGONAL FLOW FAN

INCORPORATION BY REFERENCE

The present application claims priority from Japanese application JP 2006-342071 filed on Dec. 20, 2006, the content of which is hereby incorporated by reference into this application.

BACKGROUND OF THE INVENTION (1) Field of the Invention

The present invention relates to a diagonal flow fan.

(2) Description of Related Art

Heretofore, various methods for reducing the noise of the fans have been proposed, and for example, there are some fans disclosed in Patent Document 1 (JP-A-11-201099) and Patent Document 2 (JP-A-2001-115821). Any of these fans is configured to reduce the noise by a silencer. The Patent Document 1 discloses a fan having a sound absorbing structure on the upper stream side of the fan for diminishing the noise and sucking not from an axial direction but from a radial direction. The Patent Document 2 discloses an air blower having a cylindrical main body configured to suck from a radial direction, in which noise absorbing part bodies are disposed in the suction port directly opposite one another retaining predetermined spacing.

In general, a diagonal flow fan is characterized in that, comparing with a centrifugal fan, the air pressure is low and the quantity is much, and comparing with an axial flow fan, the air pressure is high and the quantity is little, whereas the diagonal flow fan targeted by the present invention is designed such that a specific speed Ns in the vicinity of the best efficiency point defined by the following formula (1) is 800 to 1400.

$$\text{Specific speed } Ns = N \times Q^{0.5} \times H^{-0.75} \qquad \text{Formula (1)}$$

N: number of revolutions ($min^{-1}$)

Q: quantity ($m^3$/min)

H: head (m)=pressure/acceleration of gravity g/γ

γ: fluid density

This is a dimensionless quantity issuing a guide line for designing whether it is the pressure type or the quantity type when the standard state of the air is 1.2 kg/$m^3$ and the specific speed Ns is considered based on the outer diameter of the same impeller, and shows that the higher the specific speed Ns is, the more the quantity is. Hence, a flow noise of the flow becomes a main component in the noise of the diagonal flow fan. That is, when a frequency analysis is conducted, the component of frequency of 500 to 1000 Hz (hereinafter, this frequency range is referred to as moderate frequency range) becomes loud. One example of the noise characteristic of the diagonal flow fan in which the specific speed Ns is 1000 is shown in FIG. 4.

In the technique disclosed in the Patent Document 1, when the silencer is configured to suck from a radial direction, a fan casing rather than a suction port becomes larger in the centrifugal fan, which is required to provide a scroll or a fluid recovery flow channel around the impeller. Consequently, though the entire configuration does not become large by the configuration itself of the silencer, in the case of the diagonal flow fan, since the suction port and the fan casing have approximately the same size in outer shape, there has been a problem that the outer shape of the entire fan becomes large due to the configuration of the silencer.

In the Patent Document 1, sound absorption of the noise depends on the characteristic and the surface area of a sound absorbing material as well as the shape such as a thickness.

The sound absorbing characteristic of the sound absorbing material can obtain high sound absorption coefficient in the high frequency of or above 1000 Hz, whereas in the case of a fan having specific speed Ns of 800 to 1400 such as the diagonal flow fan, rather than the noise of the high frequency range, the noise of the moderate frequency range is liable to be generated, and there has been a problem that the noise is not sufficiently absorbed.

That is, in the diagonal flow fan, since a pressure interfered sound with the fan casing is low in noise characteristic, the noise of the moderate frequency range of 500 to 1000 Hz generated by the turbulence of the flow at the suction time becomes loud, and there has been a problem that the noise in this moderate frequency range is required to be reduced.

Similarly in the technique disclosed in the Patent Document 2, though the silencer is configured to suck from the radial direction, it is configured to depend on the sound absorbing material similarly to the Patent Document 1. That is, the air blower of the Patent Document 2 is not the diagonal flow fan, and for this reason, it is different in the noise characteristic, and does not give consideration to the noise of the moderate frequency range.

BRIEF SUMMARY OF THE INVENTION

The present invention has been made in view of the above described problems, and an object of the invention is to obtain a compact type diagonal flow fan or a silencer for the diagonal flow fan, while suppressing the noise of the moderate frequency range.

To achieve the above described object, in the diagonal flow fan comprising a diagonal flow impeller in which blades are disposed so as to obliquely send air to an axis of rotation, a fan casing covering this diagonal flow impeller, and a suction port for sucking a fluid in the direction to the axis of rotation of the fan casing, the present invention uses the following means.

(1) The open front side of the suction port is provided with a sound absorbing portion comprising a shield and a punching metal.

(2) In addition to the above item (1), the suction port is configured to suck the fluid in a radial direction from between the sound absorbing portion and the suction port.

(3) In addition to the above item (1), the sound absorbing portion is configured to have the same outer shape as the suction port.

(4) In addition to the above item (1), the sound absorbing portion is configured to be set inside the front projection surface of the fan casing.

(5) In addition to the above item (1), a length of an air space in the direction to the axis of rotation is configured to be set between the shield and the punching metal so that the frequency characteristic of the sound generated when the fluid fed by the diagonal flow fan is discharged from the suction port through the fan casing and the sound absorbing characteristic of the frequency of the sound reduced by the sound absorbing portion are made consistent with each other.

(6) In addition to the above item (1), the punching metal is configured to have a shape to allow the frequency characteristic of the sound generated when the fluid fed by the diagonal flow fan is discharged from the suction port through the fan casing to be consistent with the sound absorbing characteristic of the frequency of the sound reduced by the sound absorbing portion.

(7) In the above item (6), the open area ratio, the size or the thickness of the hole are configured to be set such that the frequency characteristic of the sound generated when the fluid fed by the diagonal flow fan is discharged from the suction port through the fan casing is made consistent with the sound absorbing characteristic of the frequency of the sound reduced by the sound absorbing portion.

(8) In any of the above items (1) to (5), the silencer is configured such that a porous sound absorbing material is used in place of the punching metal.

Further, the diagonal flow fan comprising each of the above described configurations is characterized in that the specific speed Ns in the vicinity of the best efficiency point of the diagonal flow fan is 800 to 1400.

According to the present invention, while suppressing the noise of the moderate frequency range, a compact diagonal flow fan or a silencer for the diagonal flow fan can be obtained.

Other objects, features and advantages of the invention will become apparent from the following description of the embodiments of the invention taken in conjunction with the accompanying drawings.

DETAILED DESCRIPTION OF THE INVENTION

Hereinafter, the structures of a diagonal flow fan and a silencer for the diagonal flow fan which are the embodiment of the present invention will be described in detail by using the drawings.

Figure 1:
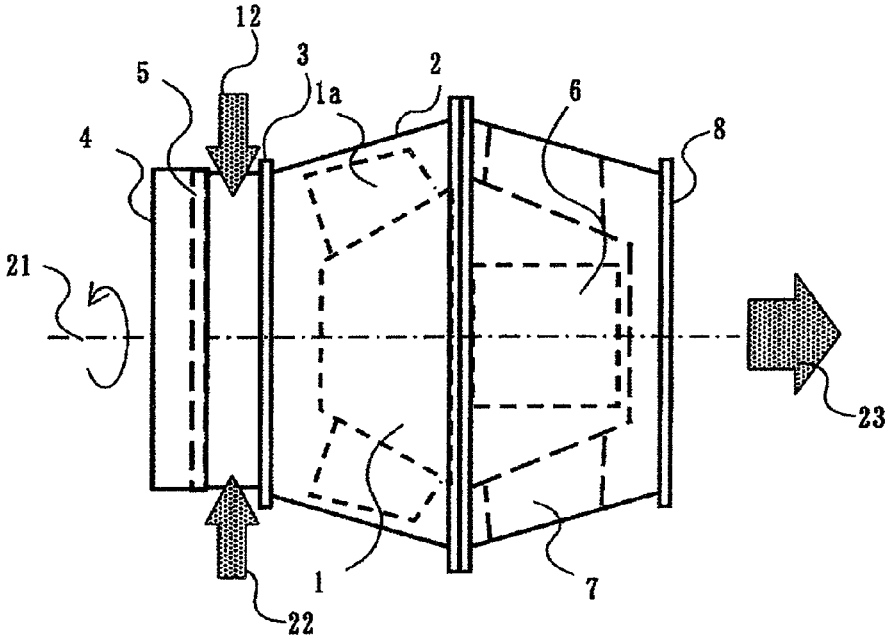
FIG. 1 is a view schematically showing the configuration of a diagonal flow fan having a silencer attached thereon.

FIG. 1 is a view schematically illustrating the configuration of the diagonal flow fan having the silencer attached thereon. In the present embodiment, a suction portion 3 of the diagonal flow fan is provided with a silencer for the diagonal flow fan. Specifically, the silencer is provided at the open front side of the suction port 3. The front side referred to here represents an upper stream side of the fluid flowing into the direction to the axis of rotation 21, and it is at the left side in FIG. 1. FIG. 1 shows a configuration seen from the horizontal direction in a state in which the silencer is attached.

The diagonal flow fan of the present embodiment is configured such that a diagonal flow impeller 1 having a blade 1*a* provided obliquely to the axis of rotation 21 is covered by a fan casing 2. The inner side of the fan casing 2 becomes a flow channel of the fluid fed by the diagonal flow impeller 1, and the inner diameter of the portion which has the maximum diameter is made larger than the inner diameter of the suction port 3. Further, the outer diameter of a portion which has the maximum diameter is also configured to be larger than the outer diameter of the suction port 3. Further, inside the fan casing 2, an electric motor 6 driving the diagonal flow impeller 1 is provided, and the axis of rotation of the electric motor 6 is coaxial with the axis of rotation 21 of the diagonal flow impeller 1. Incidentally, shown by reference number 7 is a guide vane.

As a result of the above described configuration, the fluid sucked from the suction port 3 is fed to a discharge port 8 at the down stream side in the direction to the axis of rotation 21 through the fan casing 2 covering the outer periphery of the diagonal flow impeller 1. Consequently, as shown by a sucking flow 22 and a discharging flow 23 in the drawing, the fluid sucked from the radial direction of the diagonal flow impeller 1 is fed to the direction of the axis of rotation 21 inside the fan casing 2 from the suction port 3, and is discharged from the discharge port 8.

The silencer comprises a shield 4 and a punching metal 5, and at the upper stream side (front side) in the direction of the axis of rotation 21 of the suction port 3, the shield 4 and the shield 5 are attached. As described above, the sucking flow 22 flows into the suction port 3 from the radial direction, and the silencer absorbs the sound generated when the fluid reaches the discharging flow 23 from the sucking flow 22. The external shape of the silencer has the same size as the suction port 3. Consequently, the silencer is configured to be accommodated inside the upper stream projection surface of the fan casing 2. As a result, even when the silencer is attached, the diagonal flow fan can be reduced in size in the radial direction.

The silencer of the present embodiment configures a sound absorbing portion in the diagonal flow fan having a sound absorbing function, and the sound absorbing effect can be brought about by providing the shield 4 and the punching metal 5 at the portion opposite the opening sucked into the portion covering the outer periphery of the diagonal flow impeller 1 of the fan casing 2.

Figure 2:
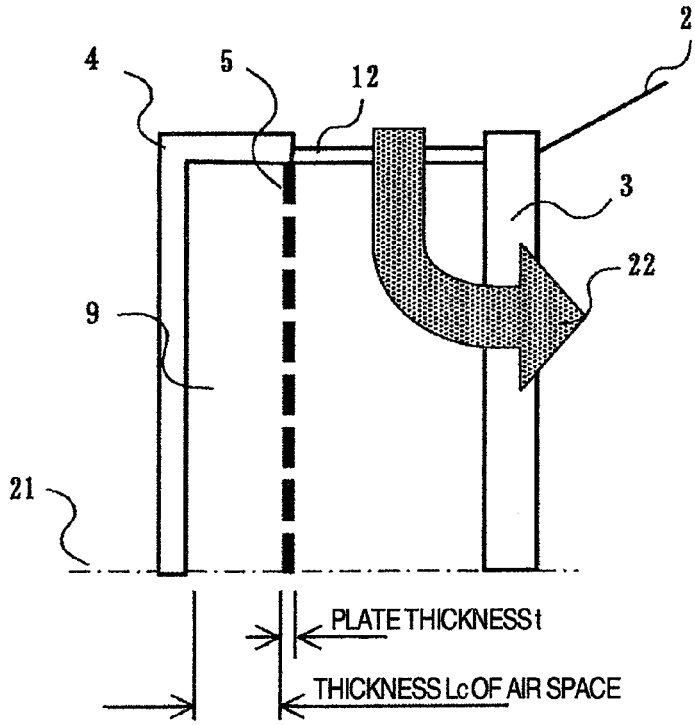
FIG. 2 is an enlarged view of main components of FIG. 1.

FIG. 2 is a view showing in detail the vicinity of the silencer and the suction port 3 of the diagonal flow fan, and is an enlarged view of main components of FIG. 1. The fluid is, as described above, sucked into the suction port 3 from the radial direction (see the sucking flow 22). The fluid is loaded up to the front projection portion (open front side of the upper stream side) of the suction portion 3 from the radial direction, and is sucked into the fan casing 2 from the suction port 3, and is fed to the direction of the axis of rotation 21. The silencer is provided with the punching metal 5 installed opposite to the suction port 3 and the shield 4 disposed opposite to the side of the suction port 3 through an air space 9 relative to this punching metal 5, and absorbs the noise in the fluid absorption.

The punching metal 5 comprises the metal member of a plate thickness t, and the shield 4 is provided at the rear side (opposite to the suction port 3) isolated at a spacing of the thickness Lc of an air space 9.

Incidentally, with respect to the support of the sound absorbing portion and the fan casing 2, to suppress the hampering of the fluid flow to the minimum, a support portion 12 is disposed on the circumference. When a metal net is used as the support portion 12, a fluid loading port is covered with the metal net, whereby the intake of a foreign matter is suppressed and the ingress of the foreign matter into the suction port 3 can be effectively prevented.

Figure 3:
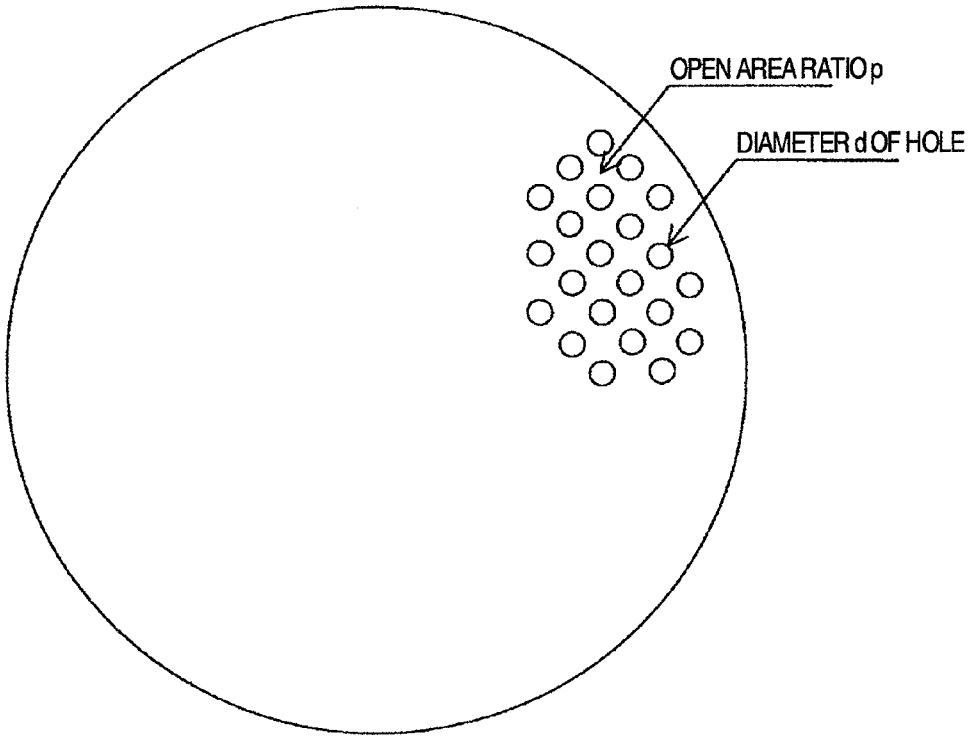
FIG. 3 is a top plan view of a punching metal.

FIG. 3 is a top plan view of the punching metal 5, and shows one example of the punching metal used in the present embodiment. In the present embodiment, a diameter of the hole opened in the metal member is d, and a punching metal of an open area ratio p is used. Incidentally, the holes are uniformly provided on the flat surface of the punching metal 5, and FIG. 3 illustrates a part of the holes uniformly provided.

In general, the diagonal flow fan such as used in the present embodiment is characterized in that it is low in pressure and much in quantity as compared with the centrifugal fan, and is high in pressure and little in quantity as compared with the axial flow fan. There is a specific speed Ns as a dimensionless quantity, which shows a guide line for the fan characteristic. In the diagonal flow fan, the specific speed Ns defined in the formula (1) is designed at 800 to 1400 in the vicinity of the best efficiency point.

$$\text{Specific speed } Ns = N \times Q^{0.5} \times H^{-0.75} \quad \text{Formula (1)}$$

N: number of revolutions ($min^{-1}$)

Q: quantity ($m^3$/min)

H: head (m)=pressure/acceleration of gravity g/γ

γ: fluid density

This is a dimensionless quantity issuing a guide line for designing whether this fan is the pressure type or the quantity type when the standard state of the air is 1.2 kg/$m^3$ and the specific speed Ns is considered based on the impeller of the same outer diameter, and shows that the higher the specific speed Ns is, the more the quantity is. Hence, a flow noise of the flow becomes a main component in the noise of the diagonal flow fan. That is, when a frequency analysis is conducted, the component of frequency of 500 to 1000 Hz (hereinafter, this frequency range is referred to as moderate frequency range) becomes loud.

Figure 4:
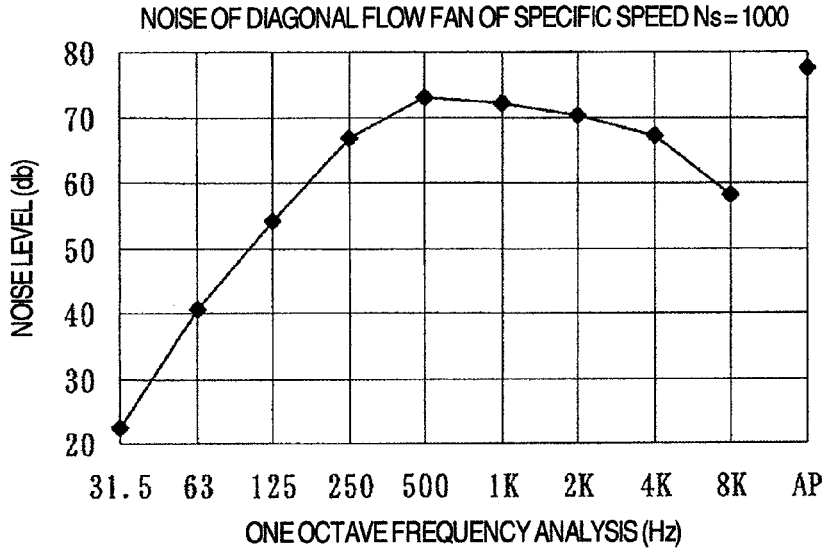
FIG. 4 is a view showing the frequency characteristic of the noise of a diagonal flow fan of specific speed=1000.

FIG. 4 is a view showing one example of the frequency characteristic of the noise of the diagonal flow fan of the specific speed Ns=1000, and shows a frequency characteristic of the noise. As illustrated as one example, in the case of the diagonal flow fan of Ns=800 to 1400, the noise of the moderate frequency range is loud, and this is required to be reduced, but there is a problem that, as compared with the noise of the high frequency range, the sound absorption is difficult to perform.

The silencer configured to use a perforated plate such as the punching metal 5 of the present embodiment and provided with an air space 9 at its rear side is regarded as an aggregate of a Helmholtz resonator based on an air spring theory in principle, and the resonance frequency changes by the shape of the perforated plate and the thickness of the air space. This resonance frequency is given by the following formula (2).

$$\text{Resonance Frequency } fr = c2\pi\sqrt{(p(t+0.8d)Lc)} \quad \text{Formula (2)}$$

c: sound velocity 340. m/s in the standard state p: open area ratio of the perforated plate t: plate thickness of the perforated plate d: diameter of the hole Lc: thickness of the air space in the back In the diagonal flow fan of the present embodiment, as described above, since it is a fan of the quantity type high in specific speed, a flow noise of the flow becomes a main component in the noise of the diagonal flow fan. As a result, as shown in FIG. 4, the component of the moderate frequency range of 500 to 1000 Hz becomes loud.

Hence, in the present embodiment, to reduce the noise due to the turbulence of the flow from the suction port of 500 to 1000 Hz, the punching metal 5 shown in FIG. 3 is used for the silencer. When the punching metal 5 shown in FIG. 3 is used, the sound absorption coefficient is set to be high in 500 sound to 1000 Hz.

Figure 5:
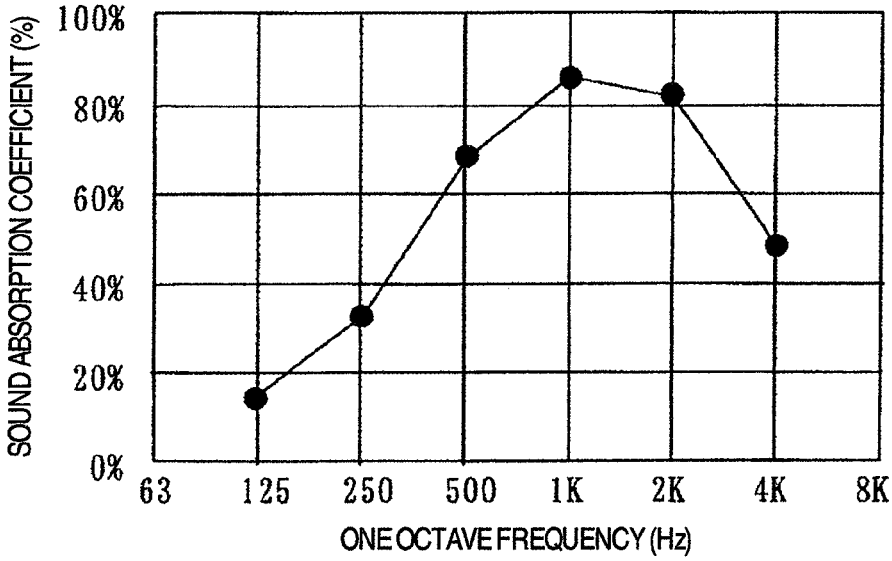
FIG. 5 is a view showing the sound absorbing characteristic when using a silencer of the present embodiment.

FIG. 5 shows one example of an absorption effect every one octave frequency when the silencer of the present embodiment is used, and shows sound absorbing characteristic. In this example, the open area ratio p of the perforated plate=0.3(30%), the plate thickness t of the perforated plate=0.004 m, the diameter d of the perforated plate=0.02 m, and the thickness Lc of the air space in the back of the perforated plate=0.08 m. At this time, the resonance frequency is fr=741 Hz, and as shown in FIG. 5, the silencer of the sound absorbing characteristic with the resonance frequency as a peak can be configured.

Similarly to the present embodiment, when the configuration of the silencer consists of the shield 4, the punching metal 5, and the air space 9, the materials excellent in resistance to climatic conditions and resistance to corrosion are used for the shield 4 and the punching metal 5, so that the silencer suitable to outdoor installation and the like can be realized for the silencer using the noise absorbing material. The diagonal flow fan of the present embodiment, as compared with the centrifugal fan, is low in pressure and much in quantity, and therefore, is used for crowd heat generation equipment, for example, for cooling heat generation equipment for automobile.

Particularly, even when the silencer is configured to be attached at the suction port 3 side of the diagonal flow fan and load the fluid from the radial direction, the noise of the moderate frequency range can be effectively suppressed, while the attempt is made at the miniaturization of the diagonal flow fan.

Further, the air space 9 provided between the shield 4 and the punching metal 5, by changing a length (thickness) in the direction to the axis of rotation 21, can change the frequency of the sound reduced by the silencer. Consequently, the size of the Lc can be changed according to the frequency generated, and the sound of the moderate frequency range can be also absorbed.

In addition, by changing the shape, for example, the open area ratio p, the hole size d, and the thickness t of the punching metal 5, the frequency of the sound reduced by the sound absorbing portion can be changed.

Thus, similarly to the diagonal flow fan of the present embodiment, the noise of the moderate frequency range can be effectively suppressed by setting the thickness of the air space 9 such that both characteristics of the frequency characteristic (FIG. 4) of the sound generated when the fluid is discharged from the suction port 3 through the fan casing 2 and the sound absorbing characteristic (FIG. 5) of the frequency of the sound reduced at the sound absorbing portion are made consistent with each other.

The shape of the punching metal 5 may be also formed such that both of the characteristics are made consistent with each other, and by setting the open area ratio and the hole size or the thickness t of the punching metal 5, the noise can be suppressed in consistent with the characteristic of the diagonal flow fan.

Figure 6:
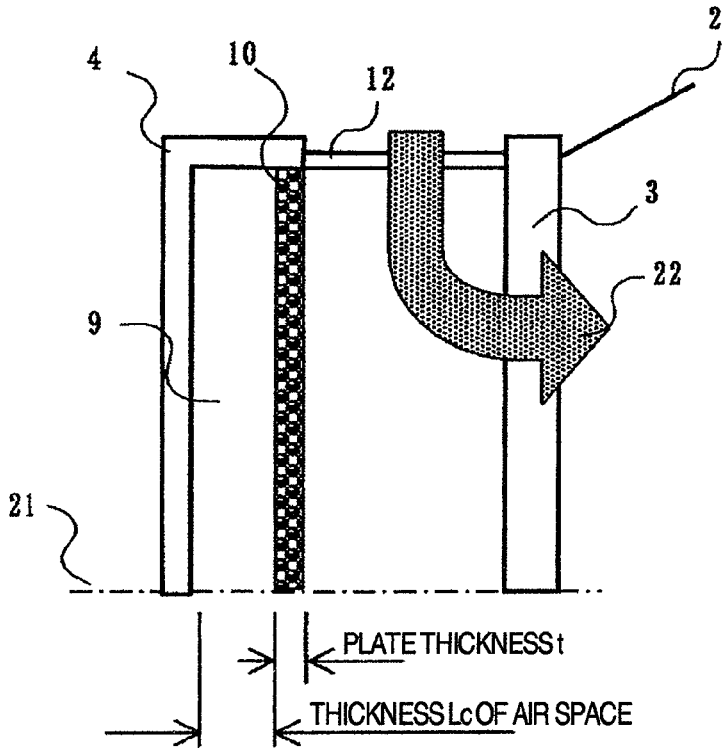
FIG. 6 is a view showing another embodiment different from FIG. 1.

FIG. 6 is a view showing another embodiment when a porous sound absorbing plate 10 is used in place of the punching metal 5 for FIG. 1. The sound absorbing characteristic of the porous material comprising no air space shows a characteristic in which the sound absorption coefficient is low at the low frequency, and approaches 100% as the frequency increases. Similarly to this example, in the case of the silencer provided with the air space 9 at the back of the porous material 10, a characteristic is obtained in which, when the air space 9 is provided at the back, as compared with the case having no air space, high sound absorbing characteristic is shown at the low frequency. In the present embodiment, this characteristic is used.

This characteristic is said to be owing to a stationary wave of the air space, and can be seen in the frequency range in which the thickness of the air space is an integral multiple of an ¼ wavelength, and therefore, in the silencer of the present invention, to reduce the noise of the moderate frequency range of 500 to 1000 Hz by the turbulence of the flow from the suction port, when the thickness of the air space is set to a length of 0.11 m of the ¼ wavelength in the standard state of 750 Hz, the effective reduction of the noise can be obtained.

At this time, since the integral multiple of an ½ wavelength makes the sound absorption coefficient low, the thickness of the air space is decided in consideration of the noise characteristic of the target diagonal flow fan.

Figure 7:
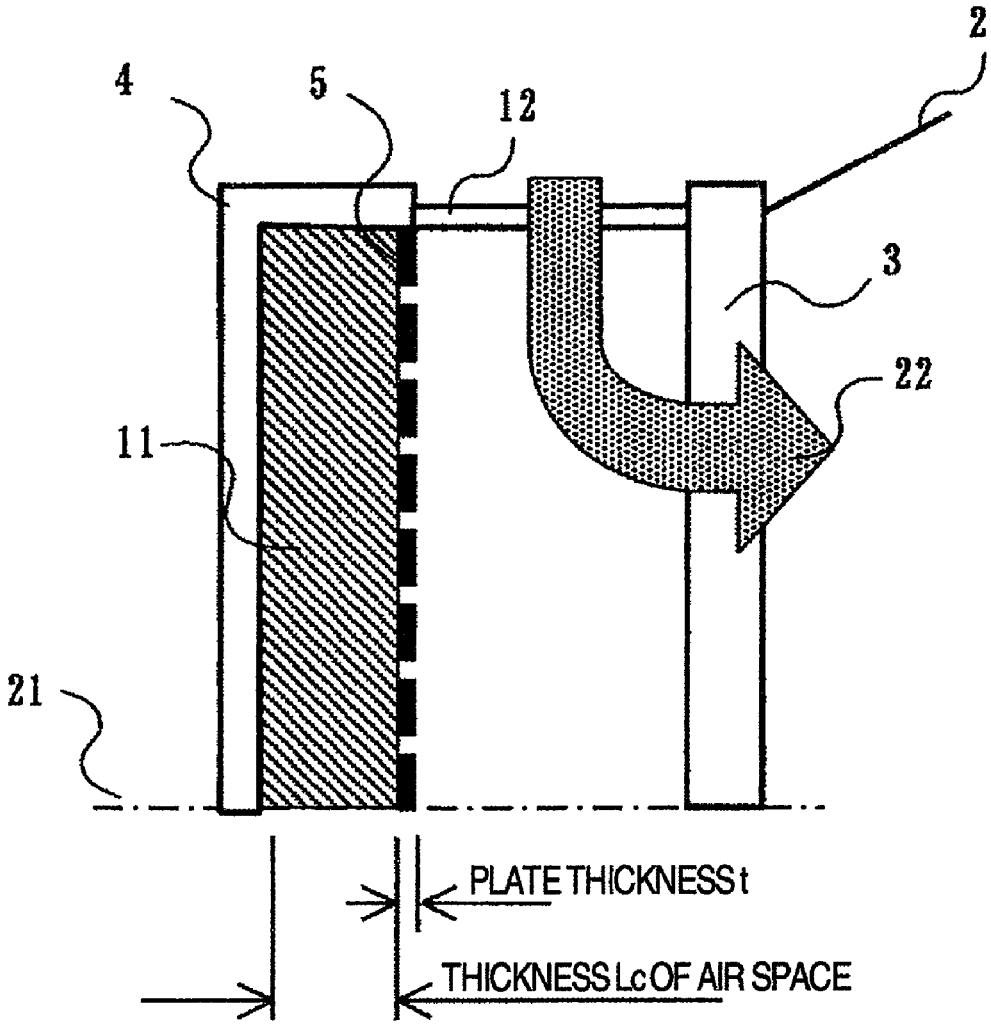
FIG. 7 is a view showing still another embodiment different from FIGS. 1 and 6.

FIG. 7 is a view showing another embodiment when a sound absorbing material 11 such as a molt plane and a glass wool is filled into the region equivalent to the air space at the back of the punching metal 5 for the embodiment of FIG. 1. The sound absorbing effect in this case has no resonance effect because the air space is no longer in existence, and becomes a characteristic depending on the sound absorbing characteristic of the sound absorbing material. However, by the reflection of the sound by the shield and the punching metal, the number of times the sound passes through the sound absorbing material increases, and the sound absorbing characteristic higher than the sound absorbing characteristic by a single piece of the sound absorbing material is obtained. At this time, even when a porous sound absorbing plate is used, the same effect can be obtained.

According to the above described embodiments according to the present invention, as compared with the conventional art, the diagonal flow fan and the silencer for the diagonal flow fan can be provided, which have the same outer shape as the suction port and are compact in size, and can obtain an effective sound absorbing effect of the moderate frequency range. When based on such configuration, the increasing of the size of the diagonal flow fan provided with the silencer can be suppressed, and the diagonal flow fan capable of achieving much higher upgrade than before can be provided.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A diagonal flow fan, comprising a diagonal flow impeller having a blade disposed so as to obliquely send an air to an axis of rotation, a fan casing covering this diagonal flow impeller, and a suction port for sucking a fluid in a direction to the axis of rotation of the fan casing, wherein the open front side of the suction port is provided with a sound absorbing portion having a shield and a punching metal accommodated inside the front projection surface of the fan casing.

2. A diagonal flow fan, comprising a diagonal flow impeller having a blade disposed so as to obliquely send an air to an axis of rotation, a fan casing covering this diagonal flow impeller, and a suction port for sucking a fluid in a direction to the axis of rotation of the fan casing, wherein the open front side of the suction port is provided with a sound absorbing portion having a shield and a punching metal, wherein a length in the direction to the axis of rotation of an air space is set between the shield and the punching metal so that the frequency characteristic of the sound generated when the fluid fed by the diagonal flow fan is discharged from the suction port through the fan casing and the sound absorbing characteristic of the frequency of the sound reduced by the sound absorbing portion are made consistent with each other.

3. A diagonal flow fan, comprising a diagonal flow impeller having a blade disposed so as to obliquely send an air to an axis of rotation, a fan casing covering this diagonal flow impeller, and a suction port for sucking a fluid in a direction to the axis of rotation of the fan casing, wherein the open front side of the suction port is provided with a sound absorbing portion having a shield and a punching metal, wherein the punching metal has a shape such that the frequency characteristic of the sound generated when the fluid fed by the diagonal flow fan is discharged from the suction port through the fan casing and the sound absorbing characteristic of the frequency of the sound reduced by the sound absorbing portion are made consistent with each other.

4. The diagonal flow fan according to claim 3, wherein an open area ratio, a size or thickness of a hole are set such that the frequency characteristic of the sound generated when the fluid fed by the diagonal flow fan is discharged from the suction port through the fan casing and the sound absorbing characteristic of the frequency of the sound reduced by the sound absorbing portion are made consistent with each other.

5. A diagonal flow fan, comprising a diagonal flow impeller having a blade disposed so as to obliquely send an air to an axis of rotation, a fan casing covering this diagonal flow impeller, and a suction port for sucking a fluid in a direction to the axis of rotation of the fan casing, wherein the open front side of the suction port is provided with a sound absorbing portion having a shield and a porous sound absorbing material.

6. The diagonal flow fan according to claim 5, wherein the fluid is sucked in a radial direction from between the sound absorbing portion and the suction port.

7. The diagonal flow fan according to claim 5, wherein the sound absorbing portion has the same external shape as the suction port.

8. The diagonal flow fan according to claim 5, wherein the sound absorbing portion is accommodated inside the front projection surface of the fan casing.

9. The diagonal flow fan according to claim 5, wherein a length in the direction to the axis of rotation of an air space is set between the shield and the punching metal so that the frequency characteristic of the sound generated when the fluid fed by the diagonal flow fan is discharged from the suction port through the fan casing and the sound absorbing characteristic of the frequency of the sound reduced by the sound absorbing portion are made consistent with each other.

10. A diagonal flow fan, comprising a diagonal flow impeller having a blade disposed so as to obliquely send an air to an axis of rotation, a fan casing covering this diagonal flow impeller, and a suction port for sucking a fluid in a direction to the axis of rotation of the fan casing, wherein the open front side of the suction port is provided with a sound absorbing portion having a shield and a punching metal, wherein a specific speed Ns in the vicinity of the best efficiency point of the diagonal flow fan is 800 to 1400 and wherein the sound absorbing portion is accommodated inside the front projection surface of the fan casing.

11. A diagonal flow fan, comprising a diagonal flow impeller having a blade disposed so as to obliquely send an air to an axis of rotation, a fan casing covering this diagonal flow impeller, and a suction port for sucking a fluid in a direction to the axis of rotation of the fan casing, wherein the open front side of the suction port is provided with a sound absorbing portion having a shield and a punching metal, wherein a specific speed Ns in the vicinity of the best efficiency point of the diagonal flow fan is 800 to 1400 and wherein a length in the direction to the axis of rotation of an air space is set between the shield and the punching metal so that the frequency characteristic of the sound generated when the fluid fed by the diagonal flow fan is discharged from the suction port through the fan casing and the sound absorbing characteristic of the frequency of the sound reduced by the sound absorbing portion are made consistent with each other.

12. A diagonal flow fan, comprising a diagonal flow impeller having a blade disposed so as to obliquely send an air to an axis of rotation, a fan casing covering this diagonal flow impeller, and a suction port for sucking a fluid in a direction to the axis of rotation of the fan casing, wherein the open front side of the suction port is provided with a sound absorbing portion having a shield and a punching metal, wherein a specific speed Ns in the vicinity of the best efficiency point of the diagonal flow fan is 800 to 1400 and wherein the punching metal has a shape such that the frequency characteristic of the sound generated when the fluid fed by the diagonal flow fan is discharged from the suction port through the fan casing and the sound absorbing characteristic of the frequency of the sound reduced by the sound absorbing portion are made consistent with each other.

13. The diagonal flow fan according to claim 12, wherein an open area ratio, a size or thickness of a hole are set such that the frequency characteristic of the sound generated when the fluid fed by the diagonal flow fan is discharged from the suction port through the fan casing and the sound absorbing characteristic of the frequency of the sound reduced by the sound absorbing portion are made consistent with each other.

* * * * *